US007957964B2

(12) United States Patent
Komamura

(10) Patent No.: US 7,957,964 B2
(45) Date of Patent: Jun. 7, 2011

(54) APPARATUS AND METHODS FOR NOISE SUPPRESSION IN SOUND SIGNALS

(75) Inventor: Mitsuya Komamura, Saitama (JP)

(73) Assignee: Pioneer Corporation, Tokyo (JP)

( * ) Notice: Subject to any disclaimer, the term of this patent is extended or adjusted under 35 U.S.C. 154(b) by 993 days.

(21) Appl. No.: 11/794,130

(22) PCT Filed: Dec. 1, 2005

(86) PCT No.: PCT/JP2005/022095

§ 371 (c)(1),
(2), (4) Date: Jul. 17, 2007

(87) PCT Pub. No.: WO2006/070560

PCT Pub. Date: Jul. 6, 2006

(65) Prior Publication Data

US 2008/0010063 A1 Jan. 10, 2008

(30) Foreign Application Priority Data

Dec. 28, 2004 (JP) ..... 2004-382163

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS

| | | | | |
|---|---|---|---|---|
| 7,158,932 | B1 * | 1/2007 | Furuta | 704/226 |
| 2002/0128830 | A1 | 9/2002 | Kanazawa et al. | |
| 2003/0076947 | A1 | 4/2003 | Furuta et al. | |
| 2004/0102967 | A1 | 5/2004 | Furuta et al. | |

FOREIGN PATENT DOCUMENTS

| | | | |
|---|---|---|---|
| EP | 1 100 077 | A2 | 5/2001 |
| JP | 8-022297 | A | 1/1996 |
| JP | 9-311698 | A | 12/1997 |
| JP | 2001-134287 | A | 5/2001 |
| JP | 2002-221988 | A | 8/2002 |
| JP | 2003-101445 | A | 4/2003 |
| JP | 2004-234023 | A | 8/2004 |

OTHER PUBLICATIONS

S. F. Boll, "Suppression of Acoustic Noise in Speech Using Spectral Subtraction," IEEE Transactions on Acoustics, Speech, and Signal Processing, vol. ASSP-27, No. 2, Apr. 1979, pp. 113-120. N. Kitaoka et al., "Speech Recognition Under Noisy Environments Using Spectral Subtraction with Smoothing of Time Direction," Journal of the Institute of Electronics, Information and Communications Engineers, D-II, vol. J83-D-11, No. 2, Feb. 2000, pp. 500-508 (partial translation).

* cited by examiner

*Primary Examiner* — Susan McFadden
(74) *Attorney, Agent, or Firm* — Foley & Lardner LLP

(57) ABSTRACT

A noise suppression apparatus calculates a sound spectrum and a noise spectrum from an input sound, further calculates gain based on the sound spectrum and noise spectrum, and suppresses noise in the input sound. The noise suppression apparatus includes a first frame-dividing unit that divides the input sound into frames having a predetermined frame length, a second frame-dividing unit that divides the input sound into frames having a longer frame length than the frame length of the first frame-dividing unit, a second converting unit that converts, into a spectrum, the input sound divided into frames by the second frame-dividing unit, a smoothing unit that smoothes the converted spectrum in a frequency direction, and a gain calculating unit that calculates gain based on the smoothed spectrum and the noise spectrum.

10 Claims, 6 Drawing Sheets

APPARATUS AND METHODS FOR NOISE SUPPRESSION IN SOUND SIGNALS

TECHNICAL FIELD

The present invention relates to a noise suppression apparatus, a noise suppression method, a noise suppression program, and a computer-readable recording medium to suppress noise in a sound signal on which noise is superimposed. However, application of the present invention is not limited to the noise suppression apparatus, the noise suppression method, the noise suppression program, and the computer-readable recording medium.

BACKGROUND ART

As a simple and very effective method to suppress noise in a sound signal on which noise is superimposed, spectral subtraction that is proposed by S. F. Boll is known. By this spectral subtraction, gain is calculated using a power spectrum of a noise-superimposed sound of a current frame (for example, Non-Patent Literature 1).

Moreover, there is a method of calculating gain using a power spectrum of a noise-superimposed sound on which time-direction smoothing is performed. According to this method, to reduce the effect of a cross-correlation term, power spectrums of noise-superimposed sound of a current frame and some past frames are moving-averaged in a time direction to be smoothed. In other words, gain is calculated using a power spectrum of a time-direction-smoothed noise-superimposed sound on which time-direction smoothing is performed (for example, Non-Patent Literature 2).

Non-Patent Literature 1: S. F. Boll "Suppression of Acoustic Noise in Speech Using Spectral Subtraction", IEEE Transaction on Acoustics, Speech and Signal Processing, 1979, ASSP Magazine Vol. 27, No. 2, pp. 113-120

Non-Patent Literature 2: Norihide Kitaoka, Ichiro Akahori, and Seiichi Nakagawa "Speech Recognition Under Noisy Environment Using Spectral Subtraction and Smoothing in Time Direction", The Institute of Electronics, Information and Communications Engineers, February 2000, Vol. J83-D-II, No. 2, pp. 500-508

DISCLOSURE OF INVENTION

Problem to be Solved by the Invention

In spectral subtraction, however, since gain is calculated using a power spectrum of a noise-superimposed sound of only a current frame, the effect of a cross-correlation term becomes large, and it is difficult to estimate gain with high accuracy. Therefore, sound quality is poor since the characteristic remaining noise called musical noise is generated or a sound spectrum is distorted. Furthermore, there is a problem that the effect of improving a recognition rate is small when spectral subtraction is used as a preprocessing of sound recognition.

On the other hand, when the effect of a cross-correlation term between sound and noise is reduced by smoothing a power spectrum of a noise-imposed sound of a current frame and some past frames in the time direction, there is a problem that the accuracy of gain estimation becomes low because a sound spectrum that fluctuates in time are smoothed from the current frame to a frame that is distant in terms of time.

Means for Solving Problem

A noise suppression apparatus related to the invention according to claim 1 includes a first frame-dividing unit that divides an input sound on which noise is superimposed into frames; a first spectrum converting unit that converts, into a spectrum, the input sound that is divided into frames by the first frame-dividing unit; a sound-section detecting unit that determines whether each of the frames obtained by division by the first frame-dividing unit is a sound section or a non-sound section; a noise-spectrum estimating unit that estimates a noise spectrum using a spectrum of the input sound in a section that is determined as the non-sound section by the sound-section detecting unit; a second frame-dividing unit that divides the input sound into frames having a longer frame length than a frame length of the first frame-dividing unit; a second spectrum converting unit that converts, into a spectrum, the input sound that is divided into frames by the second frame-dividing unit; a smoothing unit that smoothes the spectrum obtained by conversion by the second spectrum converting unit in a frequency direction; a gain calculating unit that calculates gain based on the spectrum smoothed by the smoothing unit and the noise spectrum estimated by the noise-spectrum estimating unit; and a spectral subtraction unit that performs spectral subtraction by multiplying, by the gain, an input sound spectrum acquired by the first spectrum converting unit.

A noise suppression method related to the invention according to claim 7, includes dividing an input sound on which noise is superimposed into frames; converting, into a spectrum, the input sound that is divided into frames by the first frame-dividing unit determining whether each of the frames obtained by division by the first frame-dividing unit is a sound section or a non-sound section; estimating a noise spectrum using a spectrum of the input sound in a section that is determined as the non-sound section by the sound-section detecting unit; dividing the input sound into frames having a longer frame length than a frame length of the first frame-dividing unit; converting, into a spectrum, the input sound that is divided into frames by the second frame-dividing unit; smoothing the spectrum obtained by conversion by the second spectrum converting unit in a frequency direction; calculating gain based on the spectrum smoothed by the smoothing unit and the noise spectrum estimated by the noise-spectrum estimating unit; and performing spectral subtraction by multiplying, by the gain, an input sound spectrum acquired by the first spectrum converting unit.

A noise suppression program related to the invention according to claim 8, causes a computer to execute the noise suppression method according to claim 7.

A computer-readable recording medium related to the invention according to claim 9 stores therein the noise suppression program according to claim 8.

EXPLANATIONS OF LETTERS OR NUMERALS

Figure 1:
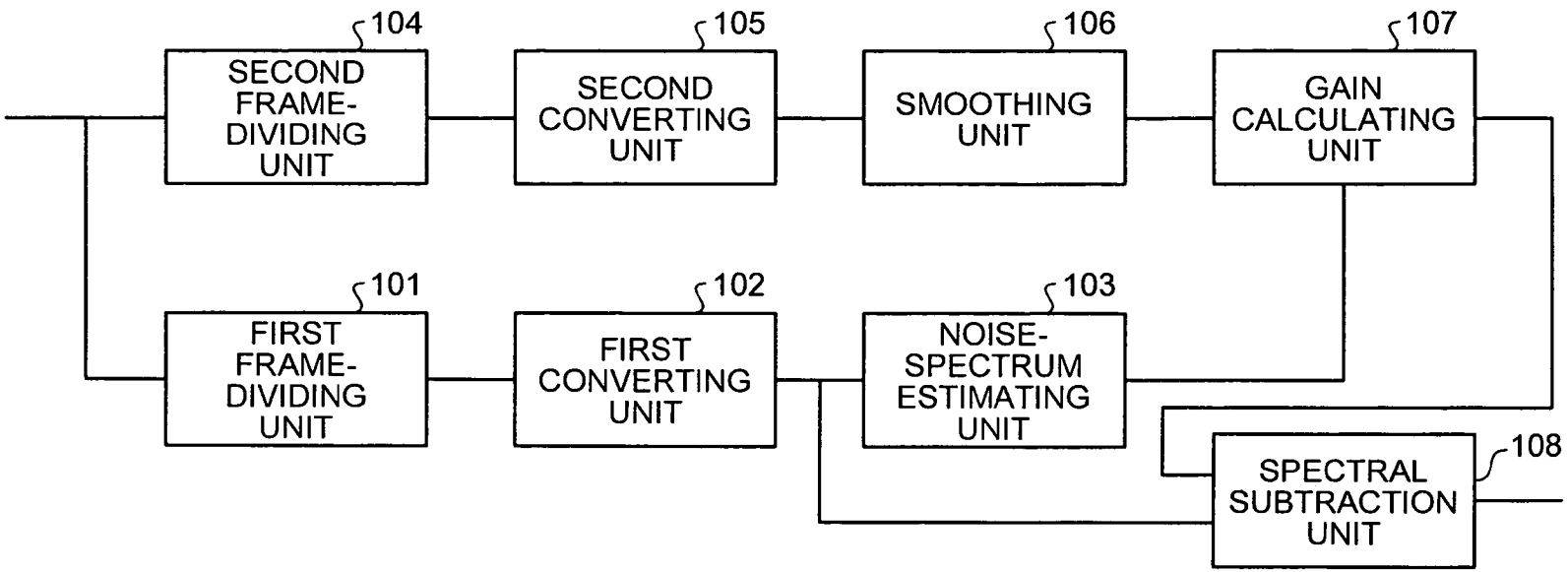
FIG. 1 is a block diagram of a functional configuration of a noise suppression apparatus according to an embodiment of the present invention.

101 First frame-dividing unit
102 First converting unit
103 Noise-spectrum estimating unit
104 Second frame-dividing unit
105 Second converting unit
106 Smoothing unit
107 Gain calculating unit
108 Spectral subtraction unit
401 Signal frame-dividing unit
402 Spectrum converting unit
403 Sound-section detecting unit
404 Noise-spectrum estimating unit
405 Gain calculating unit
406 Spectral subtraction unit
407 Waveform converting unit
408 Waveform synthesizing unit
409 Time-direction smoothing unit
601 Gain-calculation frame-dividing unit
602 Spectrum converting unit
603 Frequency-direction smoothing unit

BEST MODE(S) FOR CARRYING OUT THE INVENTION

Exemplary embodiments of a noise suppression apparatus, a noise suppression method, a noise suppression program, and a computer-readable recording medium according to the present invention are explained in detail below with reference to the accompanying drawings.

FIG. 1 is a block diagram of a functional configuration of a noise suppression apparatus according to an embodiment of the present invention. The noise suppression apparatus according to this embodiment calculates a sound spectrum and a noise spectrum from an input sound, calculates gain based on the sound spectrum and the noise spectrum, and suppresses noise in the input sound using the calculated gain. Moreover, this noise suppression apparatus includes a first frame-dividing unit 101, a first converting unit 102, a noise-spectrum estimating unit 103, a second frame-dividing unit 104, a second converting unit 105, a smoothing unit 106, a gain calculating unit 107, and a spectral subtraction unit 108.

The first frame dividing unit 101 divides the input sound into frames having a predetermined frame length. The first converting unit 102 converts the input sound that is divided into frames by the first frame-dividing unit 101 into spectrums. The noise-spectrum estimating unit 103 estimates a noise spectrum using a spectrum of a frame that is determined as a non-sound section among the spectrums converted by the first converting unit 102.

The second frame-dividing unit 104 divides the input sound into frames having a longer frame length than the frame length of the first frame dividing unit 101. The second frame-dividing unit 104 can divide the input sound into frames having an integral multiple length of, for example, twice as long as, the frame length of the first frame dividing unit 101. The first frame dividing unit 101 and the second frame-dividing unit 104 can respectively perform windowing on the divided input sound. The first frame-dividing unit and the second frame-dividing unit 104 can perform windowing on the divided input sound using a hanning window.

The second converting unit 105 converts the input sound divided by the second frame-dividing unit 104 into spectrums. The smoothing unit 106 smoothes the spectrums obtained by conversion by the second converting unit 105 in a frequency direction. For example, when the second frame-dividing unit 104 divides the input sound into frames having length twice as long as the frame length of the first frame-dividing unit 101, the smoothing unit 106 can smooth the spectrum of an even number that is converted by the second converting unit 105, using spectrums of numbers before and after the even number. In other words, the smoothing unit 106 smoothes a 2K-th spectrum that is converted by the second converting unit 105, using a (2K−1)-th spectrum, the 2K-th spectrum, and a (2K+1)-th spectrum.

The gain calculating unit 107 calculates gain based on the spectrum smoothed by the smoothing unit 106 and the noise spectrum that is estimated by the noise-spectrum estimating unit 103. The spectral subtraction unit 108 suppresses noise in the input sound by multiplying, by the gain calculated by the gain calculating unit 107, the spectrum of the input sound obtained by conversion by the first converting unit 102. The gain calculated by the gain calculating unit 107 and the spectrum of the input sound obtained by conversion by the first converting unit 102 can be input to the spectral subtraction unit 108 with the same timing.

Figure 2:
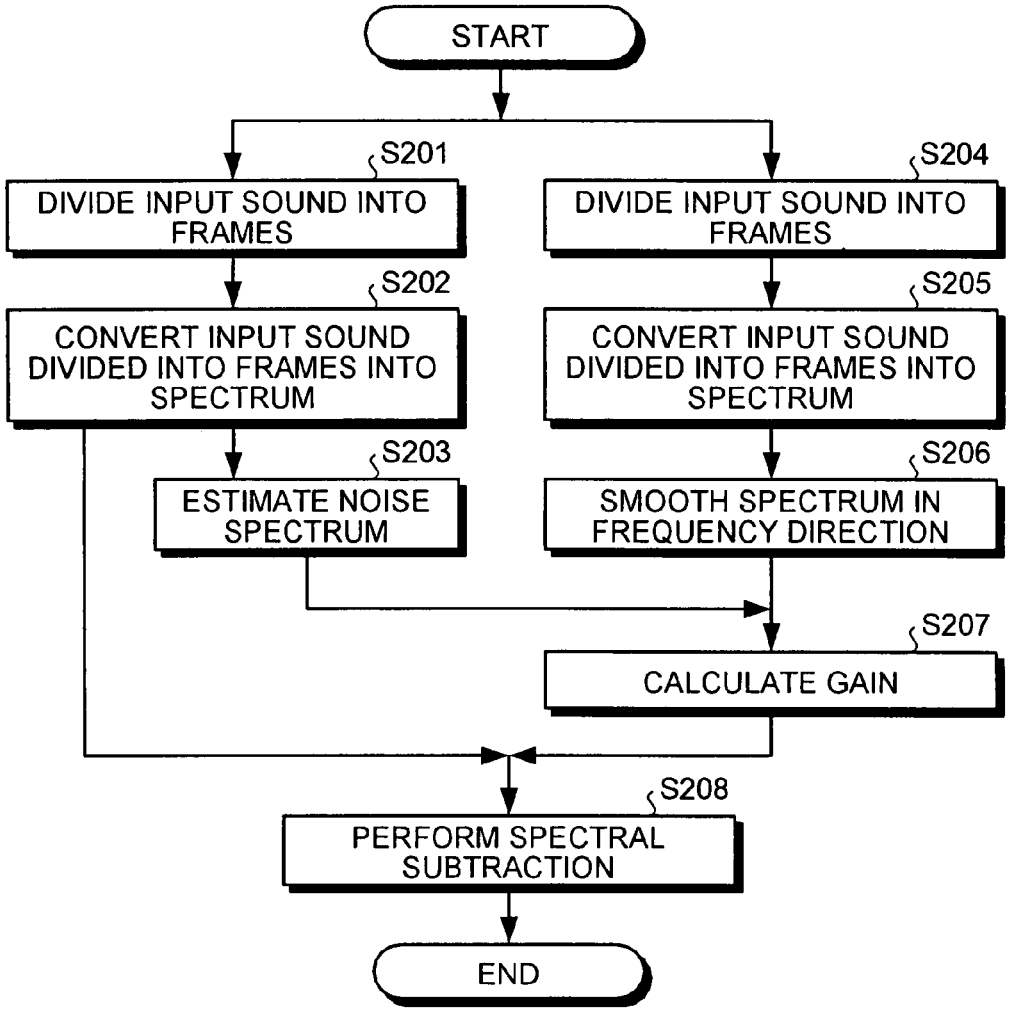
FIG. 2 is a flowchart of a process in the noise suppression method according to the embodiment of the present invention.

FIG. 2 is a flowchart of a process in the noise suppression method according to the embodiment of the present invention. First, the first frame-dividing unit 101 divides a sound into frames of a predetermined length (step S201). Next, the first converting unit 102 converts the input sound that is divided by the first frame-dividing unit 101 into spectrums (step S202). Subsequently, the noise-spectrum estimating unit 103 estimates a noise spectrum using a spectrum of a frame that is determined as a non-sound section among the spectrums obtained by conversion by the first converting unit 102 (step S203).

The second frame-dividing unit 104 divides the input sound into frames having longer frame length than the frame length of the first frame dividing unit 101 (step S204). Next, the second converting unit 105 converts the input sound divided into frames by the second frame-dividing unit 104 into spectrums (step S205). Subsequently, the smoothing unit 106 smoothes the spectrums obtained by conversion by the second converting unit 105 in a frequency direction (step S206). Next, the gain calculating unit 107 calculates gain based on the spectrum smoothed by the smoothing unit 106 and the noise spectrum that is estimated by the noise-spectrum estimating unit 103 (step S207). Subsequently, the spectral subtraction unit 108 suppresses noise in the input sound by multiplying, by the gain calculated by the gain calculating unit 107, the spectrum of the input sound obtained by conversion by the first converting unit 102 (step S208).

According to the embodiment described above, it is possible to reduce the effect of the cross-correlation term between sound and noise, and to estimate gain with high accuracy. As a result, high quality sound can be obtained, and if it is applied as a preprocessing of sound recognition, a sound recognition rate in a noisy environment can be improved.

EXAMPLE

Spectral subtraction, which is a conventional technique, is explained herein. Spectral subtraction is a technique in which a noise-superimposed sound is converted to in a spectrum region, and an estimate noise spectrum that is estimated in a noise section is subtracted from the spectrum of the noise-superimposed sound. When the noise-superimposed sound spectrum is X(k), a clean sound spectrum is S(k), and the noise spectrum is D(k), it is expressed as X(k)=S(k)+D(k). In a power spectrum region, it is expresses as in equation (1) below.

[Equation 1]

$$|X(k)|^2=|S(k)+D(k)|^2=|S(k)|^2+|D(k)|^2+2|S(k)||D(k)|\cos\theta(k) \quad (1)$$

The third term of the right side in the above equation represents the cross-correlation term. Assuming that sound and noise are uncorrelated, it is approximated as in equation (2) below.

[Equation 2]

$$|X(k)|^2=|S(k)|^2+|D(k)|^2 \quad (2)$$

From this, a clean sound power spectrum is estimated as in equation (3) below by subtracting the noise power spectrum from the power spectrum of the noise-superimposed sound.

[Equation 3]

$$|\hat{S}(k)|^2=|X(k)|^2-|\hat{D}(k)|^2 \quad (3)$$

More generally, it is estimated as in equation (4) below.

[Equation 4]

$$|\hat{S}(k)|^2=\begin{cases}|X(k)|^2-\alpha|\hat{D}(k)|^2,\\ \beta|X(k)|^2,\end{cases} \quad (4)$$

α is a subtraction coefficient, and is set to a value larger than 1 to subtract rather more estimated noise power spectrum. β is a floor coefficient, and is set to a positive small value to avoid the spectrum after subtraction being a negative value or a value close to 0. The above equation can be expressed as filtering to |X(k)| using the gain G(k).

[Equation 5]

$$G(k)=\begin{cases}\left(1-\alpha\frac{|\hat{D}(k)|^2}{|X(k)|^2}\right)^{\frac{1}{2}},\\ \beta^{\frac{1}{2}},\end{cases} \quad (5)$$

Based on equation (5) above, an estimated clean-sound amplitude spectrum is calculated from equation (6) below.

[Equation 6]

$$|\hat{S}(k)|=G(k)|X(k) \quad (6)$$

Furthermore, an estimated clean-sound spectrum is calculated from equation (7) below.

[Equation 7]

$$\hat{S}(k)=G(k)X(k) \quad (7)$$

Figure 3:
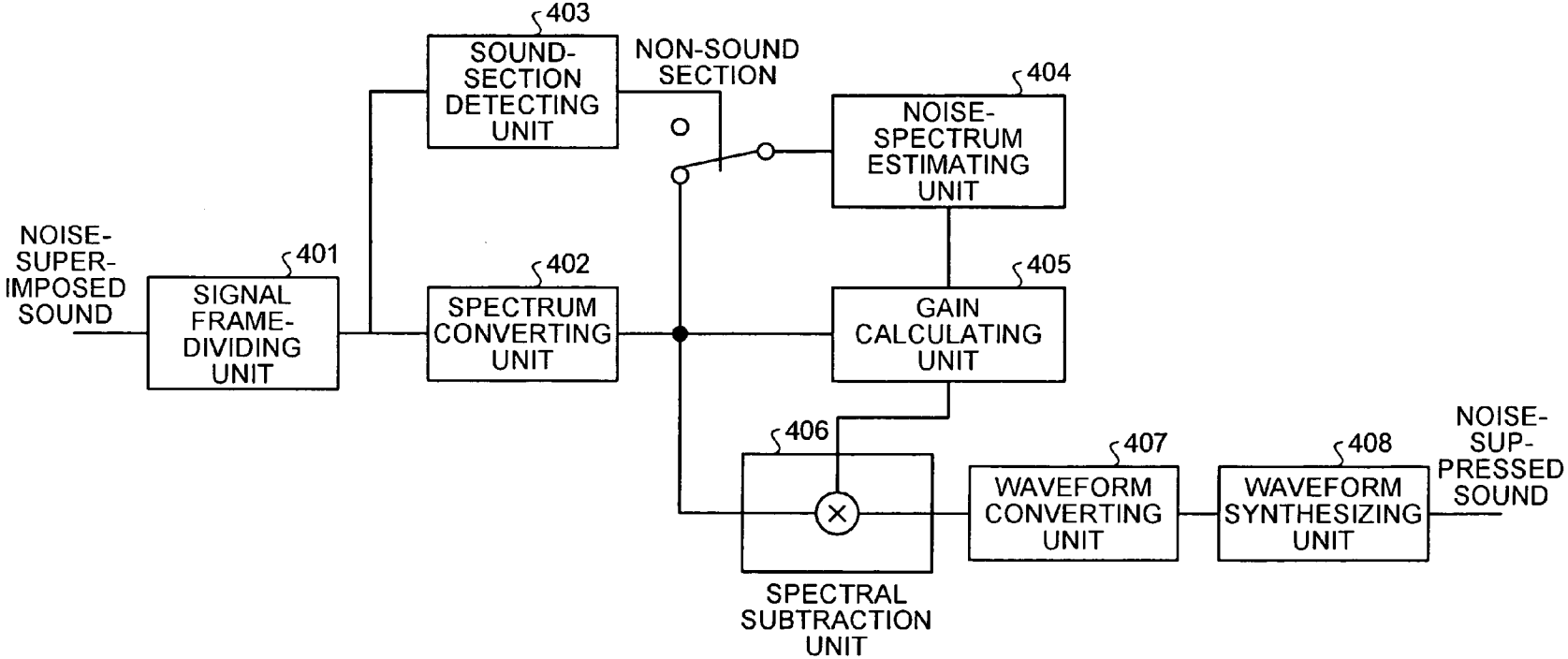
FIG. 3 is a block diagram of a functional configuration of a spectral subtraction noise-suppression apparatus according to a conventional technology.

A configuration for removing noise using the above spectral subtraction is explained next. FIG. 3 is a block diagram of a functional configuration of a spectral subtraction noise-suppression apparatus according to a conventional technology. The noise suppression apparatus shown in FIG. 3 includes a signal frame-dividing unit 401, a spectrum converting unit 402, a sound-section detecting unit 403, a noise-spectrum estimating unit 404, a gain calculating unit 405, a spectral subtraction unit 406, a waveform converting unit 407, and a waveform synthesizing unit 408.

The signal frame-dividing unit 401 divides a noise-superimposed sound into frames composed of a certain number of samples to send to the spectrum converting unit 402 and the sound-section detecting unit 403. The spectrum converting unit 402 acquires the noise-superimposed sound spectrum X(k) by discrete Fourier transform to send to the gain calculating unit 405 and the spectral subtraction unit 406. The sound-section detecting unit 403 makes sound section/non-sound section determination, and sends the noise-superimposed sound spectrum of a frame that is determined as a non-sound section to the noise-spectrum estimating unit 404.

The noise-spectrum estimating unit 404 calculates a time average of power spectrums of some past frames that have been determined as non-sound, to acquire an estimated noise power spectrum. The gain calculating unit 405 calculates gain G(k) using the noise-superimposed sound power spectrum and the estimated noise power spectrum.

The spectral subtraction unit 406 multiplies the noise-superimposed sound spectrum X(k) by the gain G(k), to estimate an estimated clean sound spectrum. The waveform converting unit 407 converts the estimated clean sound spectrum into a time waveform by inverse discrete Fourier transform. The waveform synthesizing unit 408 performs overlap-add on time waveforms of frames to synthesize a continuous waveform.

In the above spectral subtraction, assuming that sound and noise are uncorrelated, 0 is substituted into the cross-correlation term in the third term of the right side, and the noise-superimposed sound power spectrum is approximated by sum of the clean sound power spectrum and the noise power spectrum. However, even if sound and noise is uncorrelated, when short-time frame analysis is performed, the cross-correlation term does not become 0. Merely, an expected value is 0. Therefore, noise remains in the estimate clean sound after the spectral subtraction, as a result of substitution of 0 into the third term of the right side in equation (1).

Figure 4:
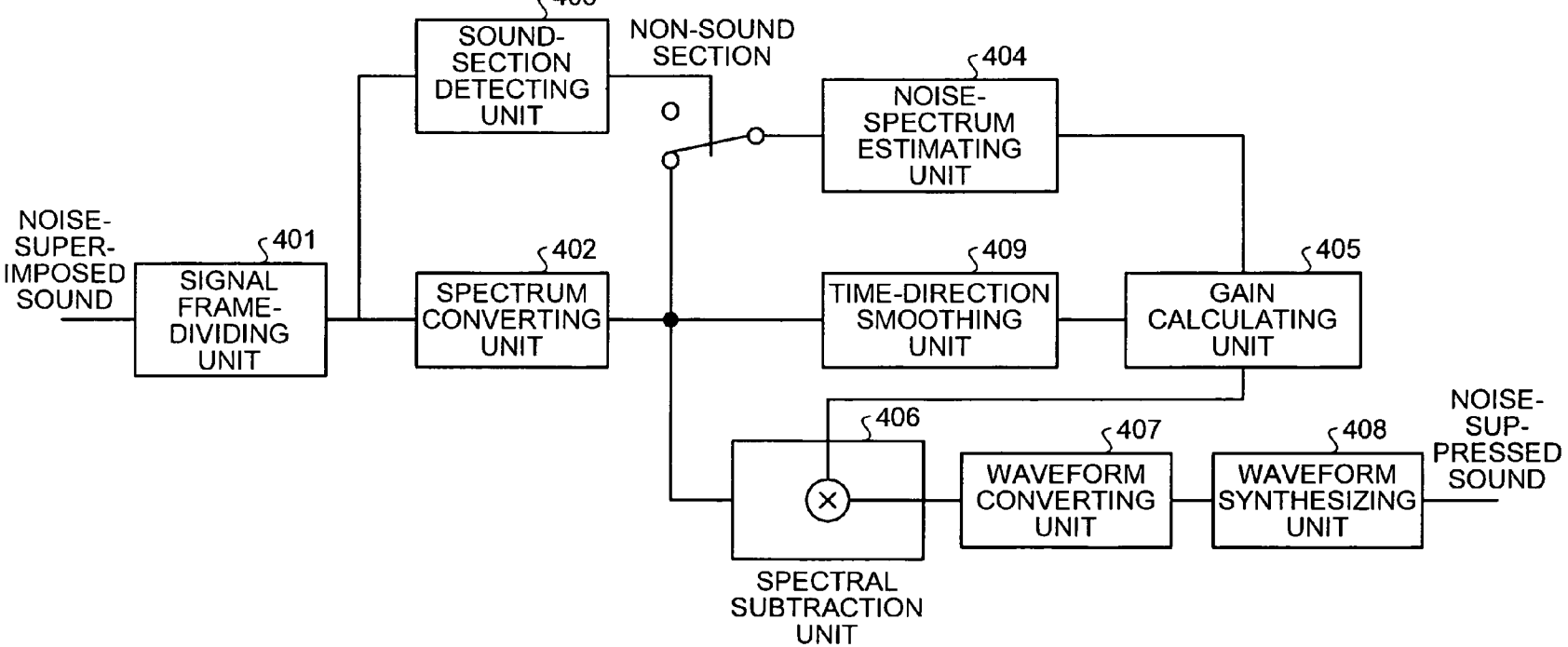
FIG. 4 is a block diagram of a functional configuration of a noise suppression apparatus using a power spectrum of a time-direction-smoothed noise-superimposed sound.

FIG. 4 is a block diagram of a functional configuration of a noise suppression apparatus using a power spectrum of a time-direction-smoothed noise-superimposed sound. The noise suppression apparatus shown in FIG. 4 has a configuration in which a time-direction smoothing unit 409 is arranged before the gain calculating unit 405 shown in FIG. 3. In this noise suppression apparatus, a power spectrum of a time-direction smoothed noise-superimposed sound of a current frame time t is calculated by a moving average of a current frame and past L frames as expressed in equation (8) below.

[Equation 8]

$$|\overline{X(k,t)}|^2=\sum_{1=0}^{L-1}a_1|X(k,t-1)|^2 \quad (8)$$

$a_1$ represents weight in smoothing, and is expressed as in equation (9) below.

[Equation 9]

$$\sum_{1=0}^{L-1}a_1=1.0 \quad (9)$$

The gain calculating unit 405 calculates gain G(k) using the power spectrum of a time-direction smoothed noise-superimposed sound that is expressed as in equation (10) instead of the power spectrum $|X(k)|^2$ of the noise-superimposed sound of a current frame in equation (5).

[Equation 10]

$$|\overline{X(k,t)}|^2 \tag{10}$$

The conventional gain calculation using the spectral subtraction has been explained above. In this example, in addition to the above configuration, a gain-calculation frame-dividing unit 601 and a spectrum converting unit 602 are arranged separately from the signal frame-dividing unit 401 and the spectrum converting unit 402, and the number of samples of gain calculation is set to be more than the number of samples of a signal frame. This enables calculation of a power spectrum of a noise-superimposed sound that is smoothed in a frequency direction, and the gain G(k) is calculated using this.

(Functional Configuration of Noise Suppression Apparatus)

Figure 5:
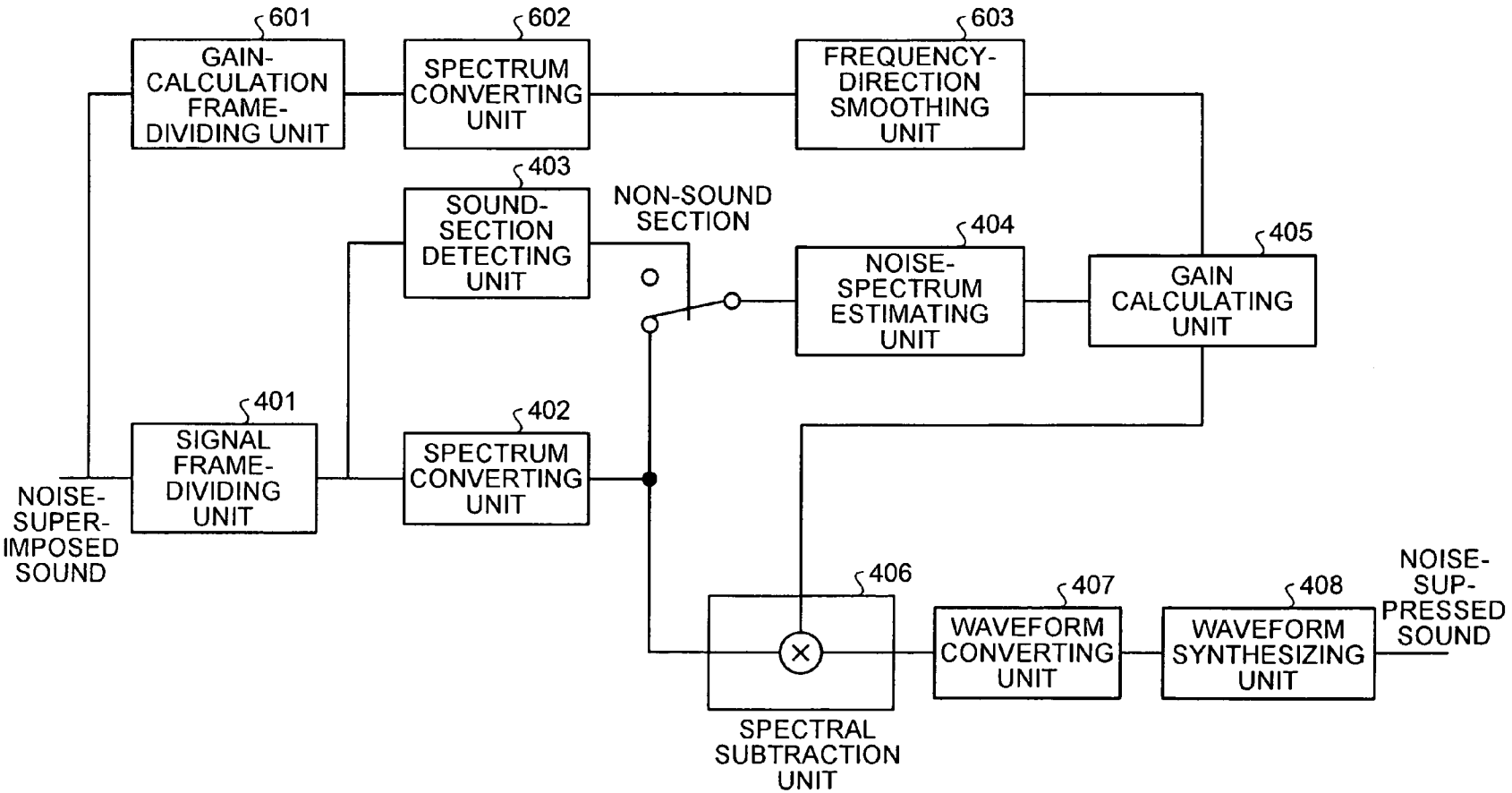
FIG. 5 is a block diagram of a functional configuration of a gain suppression apparatus according to this example.

FIG. 5 is a block diagram of a functional configuration of a gain suppression apparatus according to this example. The noise suppression apparatus shown in FIG. 5 includes the signal frame-dividing unit 401, the spectrum converting unit 402, the sound-section detecting unit 403, the noise-spectrum estimating unit 404, the gain calculating unit 405, the spectral subtraction unit 406, the waveform converting unit 407, the waveform synthesizing unit 408, the gain-calculation frame-dividing unit 601, the spectrum converting unit 602, and a frequency-direction smoothing unit 603.

Actual processing is performed by a CPU by reading a program written in a ROM and by using a RAM as a work area. The example is explained with reference to FIG. 5. First, a noise-superimposed sound is sent to the signal frame-dividing unit 401 and the gain-calculation frame-dividing unit 601.

The signal frame-dividing unit 401 divides the noise-superimposed sound into frames composed of N (for example, 256) samples. At this time, windowing is performed to enhance accuracy of frequency analysis in discrete Fourier transform (DFT). Moreover, at the time of synthesizing a waveform, to avoid a waveform that is discontinuous at borders between frames, the frames are divided so as to overlap with each other.

A noise-superimposed sound signal $x_s(n)$ that has been divided into frames is expressed as $x_s(n)=S_s(n)+d_s(n)$, $0 \leqq n \leqq N-1$. $S_s(n)$ represents a clean sound signal, and $d_s(n)$ represents noise.

The spectrum converting unit 402 converts the noise-superimposed sound signal $x_s(n)$, which has been divided into frames, into a spectrum by discrete Fourier transform. A spectrum $X_s(k)$ is expressed as $X_s(k)=S_s(k)+Ds(k)$, $0 \leqq k \leqq N-1$. $S_s(k)$ represents a k-th component of a clean sound spectrum, and $D_s(k)$ represents a k-th component of a noise spectrum. The spectrum $X_s(k)$ is sent to the spectral subtraction unit 406.

The sound-section detecting unit 403 makes sound section/non-sound section determination on the noise-superimposed sound signal $x_s(n)$ that is divided into frames in parallel, and sends the spectrum $X_s(k)=D_s(k)$ of the noise-superimposed sound signal of a frame that is determined as a non-sound section to the noise-spectrum estimating unit 404.

The noise-spectrum estimating unit 404 calculates a time average of power spectrums of some past frames that have been determined as non-sound section, and an estimated noise power spectrum DP is given by equation (11) below.

[Equation 11]

$$DP=|\hat{D}_s(k)|^2 \tag{11}$$

The gain-calculation frame-dividing unit 601 divides a noise-superimposed sound into frames composed of M (for example, 512) samples, where M is larger than N. At this time, a window center in the gain-calculation frame division is matched with a window center in the signal frame division. A noise-superimposed sound signal $x_g(m)$ divided into frames is expressed as $x_g(m)=S_g(m)+d_g(m)$, $0 \leqq m \leqq M-1$. $S_g(m)$ represents a clean sound signal, and $d_g(m)$ represents noise.

The spectrum converting unit 602 converts the noise-superimposed sound signal $x_g(m)$, which has been divided into frames, into a gain calculation spectrum by discrete Fourier transform. A gain calculation spectrum $X_g(l)$ is expressed as $X_g(l)=S_g(l)+D_g(l)$, $0 \leqq l \leqq M-1$. $S_g(l)$ represents a first component of a clean sound spectrum, and $D_g(l)$ represents a first component of a noise spectrum.

Figure 7:
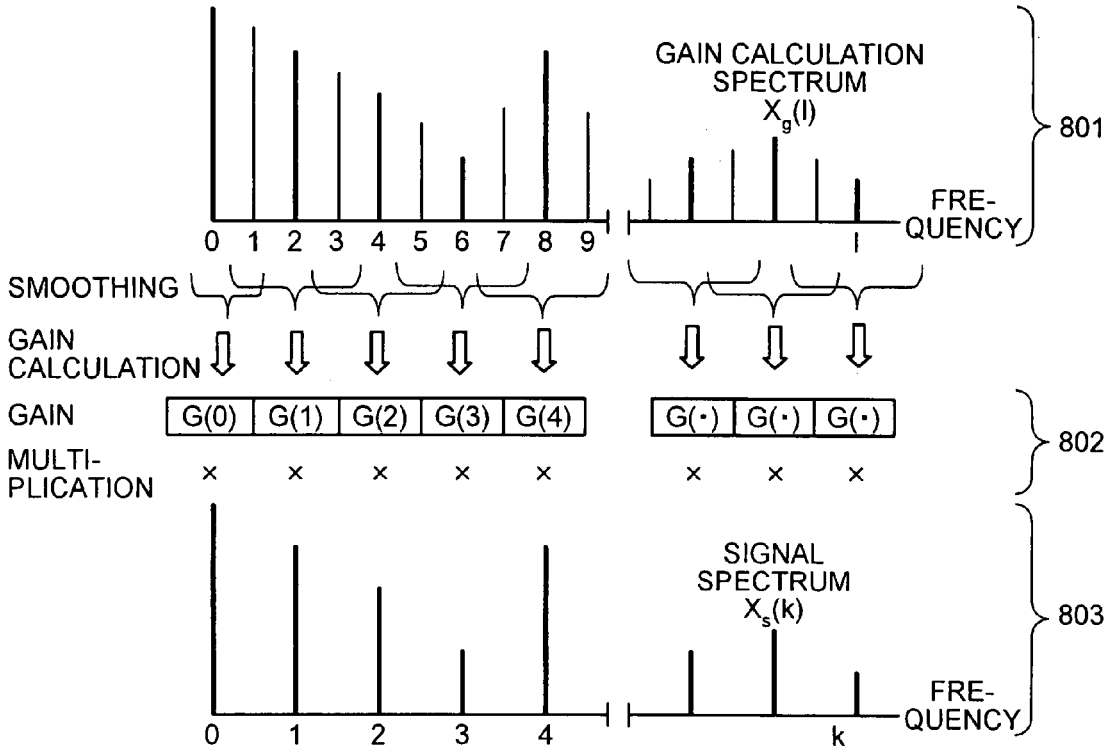
FIG. 7 is an explanatory diagram for explaining gain calculation when smoothed in a frequency direction.

The frequency-direction smoothing unit 603 smoothes the gain calculation spectrum $X_g(l)$. When the number of samples M in the gain calculation frame division is set to twice as many as the number of samples N in the signal frame (M=2N), the gain calculation spectrum $X_g(l)$ and the signal spectrum $X_s(k)$ coincide in frequency when l=2k (k=0, 1, . . . , N−1) as shown in FIG. 7 described later.

Using $X_g(2k-1)$, $X_g(2k)$, and $X_g(2k+1)$, which have $X_g(2k)$ in the middle, to calculate the gain G(k) with respect to the spectrum $X_s(k)$, a frequency-direction smoothed power spectrum XP is defined as in equation (12) below.

[Equation 12]

$$XP=|\overline{X_g(k)}|^2=a_{-1}|X_g(2k-1)|^2+a_0|X_g(2k)|^2+a_{+1}|X_g(2k+1)|^2,\quad 0 \leqq k \leqq N-1 \tag{12}$$

$a_{-1}$, $a_0$, and $a_{+1}$, represent weight in smoothing, and have a relation of $a_{-1}+a_0+a_{+1}=1.0$. In this example, it is assumed as $a_{-1}=a_0=a_{+1}=1/3$. This frequency-direction smoothed power spectrum XP is sent to the gain calculating unit 405.

The gain calculating unit 405 calculates the gain G(k) using the estimated noise power spectrum DP sent from the noise spectrum estimating unit 404 and the frequency-direction smoothed power spectrum XP as in equation (13) below.

[Equation 13]

$$G(k)=\begin{cases}\left(1-\alpha\dfrac{|\hat{D}_s(k)|^2}{|\overline{X_g(k)}|^2}\right)^{\frac{1}{2}},\\ \beta^{\frac{1}{2}},\end{cases} \tag{13}$$

α is a subtraction coefficient, and is set to a value larger than 1 to subtract rather more estimated noise power spectrum DP. β is a floor coefficient, and is set to a positive small value to avoid the spectrum after subtraction being a negative value or a value close to 0. The calculated gain G(k) is sent to the spectral subtraction unit 406.

The spectral subtraction unit 406 calculates an estimated clean sound spectrum from which the estimated noise spectrum is subtracted, by multiplying the spectrum $X_s(k)$ calculated by the spectrum converting unit 402 by the gain G(k) as in equation (14) below.

[Equation 14]

$$\hat{S}_s(k)=G(k)X_s(k) \tag{14}$$

The waveform converting unit 407 acquires a time waveform of each frame by performing inverse discrete Fourier transform (IDFT) on the estimated clean sound spectrum. The waveform synthesizing unit 408 synthesizes a continuous waveform by performing overlap-add on the time waveforms of frames to output a noise-suppressed sound.

Figure 6:
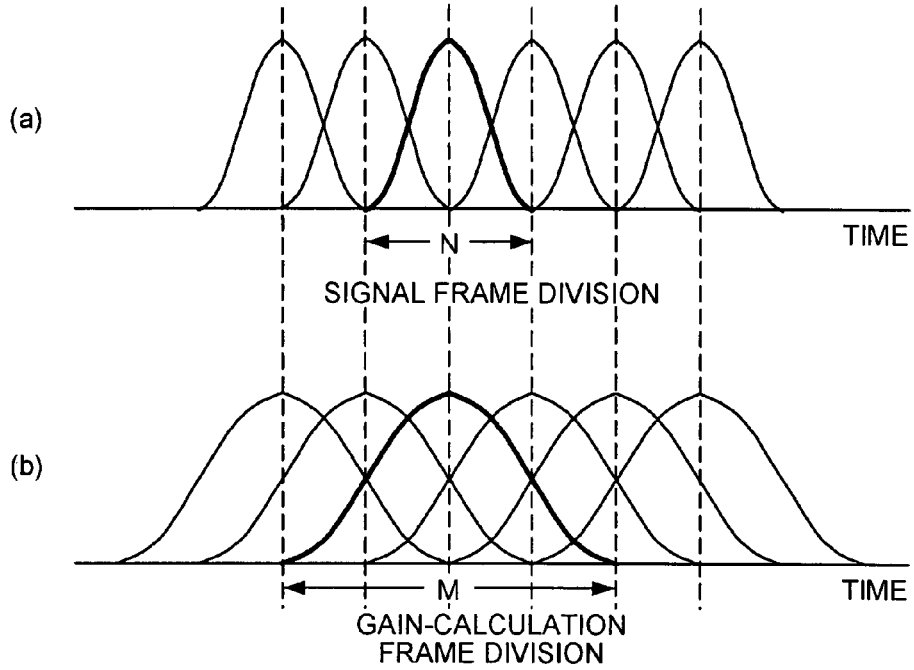
FIG. 6 is an explanatory diagram for explaining frame division of an input sound.

FIG. 6 is an explanatory diagram for explaining frame division of an input sound. FIG. 6(*a*) illustrates a case where a noise-superimposed sound is divided into frames composed of N (for example, 256) samples. At this time, windowing is performed to enhance accuracy of frequency analysis in discrete Fourier transform (DFT). Moreover, when a waveform is synthesized, to avoid a waveform that is discontinuous at borders between frames, the frames are divided so as to overlap with each other.

FIG. 6(*b*) illustrates a case where a noise-superimposed sound is divided into frames composed of M (for example, 512) samples, where M is larger than N. In this case, duration is set to be twice as much as that in case of FIG. 6(*a*). As described, the number of samples of the gain calculation frame is set to be more than the number of samples of the signal frame samples. Furthermore, a center of the gain-calculation frame is matched with a center of the signal frame.

FIG. 7 is an explanatory diagram for explaining gain calculation when smoothed in a frequency direction. As shown in a graph 801, for the gain calculation spectrum $X_g(l)$, l pieces of spectrums corresponding to a frequency are output by the spectrum converting unit 602. For the frequency-direction smoothing of the gain calculation spectrum $X_g(l)$, a plurality of spectrum components having a spectrum component that coincides with frequency of the signal spectrum component in the center are used.

For example, when the number of samples M in the gain calculation frame division is set to be twice as many as the number of samples N in the signal frame (M=2N), the gain calculation spectrum $X_g(l)$ and the signal spectrum $X_s(k)$ coincide in frequency when l=2k (k=0, 1, . . . , N−1). Specifically, the graph 801 shows spectrums corresponding to l=0, 1, . . . , and the frequency-direction smoothing is performed by combining a spectrum corresponding to an even number shown by a thick line with spectrums shown by thin lines that are present before and after such a spectrum, among these spectrums. For example, for a spectrum of l=6, spectrums of l=5 and of l=7 are used. For this, gain 802 indicated by G(3) is calculated. The gain 802 is multiplied by the spectrum $X_s(k)$ shown by a graph 803 by the spectral subtraction unit 406.

A window function is explained next. The spectrum conversion of a long signal is performed by dividing the signal into frames as described above to execute Fourier transform, and since discrete value data is used, it is discrete Fourier transform. In the discrete Fourier transform, periodicity of data is assumed. However, if two ends of clipped data take extreme values, the effect is great, resulting in distortion of a high-frequency component. As a measure against this problem, the discrete Fourier transform is performed on a result obtained by multiplying the signal by the window function. Such a process of multiplying by the window function is called windowing.

The window function is required that the width of a main lobe (region in which an amplitude spectrum near 0 frequency is large) is narrow and the amplitude of a side lobe (region in which an amplitude spectrum at a position away from 0 frequency is small) is small. Specifically, a rectangular window, a hanning window, a hamming window, a Gauss window, etc. are included.

The window function used in this example is the hanning window. The window function of the hanning window is given by $h(n)=0.5-0.5\{\cos(2\pi n/(N-1))\}$ in a range of $0 \leqq n \leqq N-1$, and in other ranges, h(n)=0. This window function is relatively low in frequency resolution of the main lobe, but the amplitude of the side lob is relatively small.

According to the example explained above, frequency-direction smoothing is performed using a plurality of spectrum components of a power spectrum of a noise-superimposed sound. Therefore, it is possible to reduce the effect of a cross-correlation term between sound and noise, and to estimate gain with high accuracy. Furthermore, since the centers of the gain calculation frame and the signal frame coincide with each other, gain can be calculated using a frame at substantially the same time as the signal frame. Therefore, gain estimation with high accuracy is possible. Accordingly, high quality sound including only little musical noise and distortion of a sound spectrum can be obtained. Moreover, if this example is applied to a preprocessing of sound recognition, an effect of improving a sound recognition rate in a noisy environment is large.

The noise suppression method explained in the present embodiment is implemented by executing a prepared program by a computer such as a personal computer and a workstation. The program is recorded on a computer-readable recording medium such as a hard disk, a flexible disk, a CD-ROM, an MO, and a DVD, and is executed by being read out from the recording medium by a computer. Moreover, the program can be a transmission medium that can be distributed through a network such as the Internet.

The invention claimed is:

1. A noise suppression apparatus comprising a processor and computer-executable code configured to execute:

dividing a sound having superimposed noise into a plurality of first frames having a first frame length;

converting the first frames into a plurality of first spectrums;

identifying each of the first frames as a sound section or a non-sound section;

estimating a noise spectrum using a first spectrum of a first frame in a section identified as the non-sound section;

dividing the sound into a plurality of second frames each having a second frame length that is longer than the first frame length;

converting the second frames into a plurality of second spectrums;

smoothing the second spectrums in a frequency direction;

calculating gain based on the smoothed second spectrums and the noise spectrum; and performing spectral subtraction by multiplying the first spectrums by the gain.

2. The noise suppression apparatus according to claim 1, wherein the second frame length is an integral multiple of the first frame length.

3. The noise suppression apparatus according to claim 2, wherein the processor and computer-executable code are configured to execute smoothing a second spectrum corresponding to an even number in a frequency-direction conversion sequence, using second spectrums respectively corresponding to a number preceding and a number following the even number, wherein the second frame length is twice as long as the first frame length.

4. The noise suppression apparatus according to claim 1, wherein the processor and computer-executable code are configured to further comprise respectively multiplying the first frames and the second frames by a window function.

5. The noise suppression apparatus according to claim 4, wherein the window function is a hanning window.

6. The noise suppression apparatus according to claim 1, wherein the gain and the first spectrums are input for performing spectral subtraction with an identical timing.

7. A noise suppression method implemented using a computer, comprising:

dividing a sound having superimposed noise into a plurality of first frames having a first frame length;

converting the first frames into a plurality of first spectrums;

identifying each of the first frames as a sound section or a non-sound section;

estimating a noise spectrum using a first spectrum of a first frame in a section identified as the non-sound section;

dividing the sound into a plurality of second frames each having a second frame length that is longer than the first frame length;

converting the second frames into a plurality of second spectrums;

smoothing the second spectrums in a frequency direction;

calculating gain based on the smoothed second spectrums and the noise spectrum using the computer; and performing spectral subtraction by multiplying the first spectrums by the gain.

8. The noise suppression method according to claim 7, further comprising:

multiplying the first frames by a window function; and multiplying the second frames by a window function.

9. A non-transitory computer-readable recording medium storing therein a computer program that causes a computer to execute:

dividing a sound having superimposed noise into a plurality of first frames having a first frame length;

converting the first frames into a plurality of first spectrums;

identifying each of the first frames as a sound section or a non-sound section;

estimating a noise spectrum using a first spectrum of a first frame in a section identified as the non-sound section;

dividing the sound into a plurality of second frames each having a second frame length that is longer than the first frame length;

converting the second frames into a plurality of second spectrums;

smoothing the second spectrums in a frequency direction;

calculating gain based on the smoothed second spectrums and the noise spectrum; and performing spectral subtraction by multiplying the first spectrums by the gain.

10. The non-transitory computer-readable recording medium according to claim 9, storing therein a computer program that further causes a computer to execute:

multiplying the first frames by a window function; and multiplying the second frames by a window function.

* * * * *